US008662627B2

(12) United States Patent
Chen et al.

(10) Patent No.: US 8,662,627 B2
(45) Date of Patent: Mar. 4, 2014

(54) IDENTIFYING A LINEHEAD PRODUCING AN ARTIFACT IN CONTENT PRINTED ON A MOVING PRINT MEDIA

(75) Inventors: Samuel Chen, Penfield, NY (US); Mark C. Rzadca, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 57 days.

(21) Appl. No.: 13/536,150

(22) Filed: Jun. 28, 2012

(65) Prior Publication Data

US 2014/0002523 A1 Jan. 2, 2014

(51) Int. Cl.
*B41J 29/393* (2006.01)

(52) U.S. Cl.
USPC ..... 347/19

(58) Field of Classification Search
USPC ..... 347/13, 42, 19
See application file for complete search history.

(56) References Cited

U.S. PATENT DOCUMENTS 7,289,248 B2 * 10/2007 Yamazaki ..... 347/19
8,393,709 B2 * 3/2013 Enge ..... 347/19

* cited by examiner

*Primary Examiner* — Lamson Nguyen
(74) *Attorney, Agent, or Firm* — Nancy R. Simon; Amit Singhal

(57) ABSTRACT

A linehead that is producing an artifact in the content printed on a print media is identified by capturing an image of the content as the print media is moving to obtain pixel data and averaging the pixel data to produce blur in a direction the print media is moving. A determination is made as to whether the averaged pixel data is associated with content printed by a first linehead in a printing module. If the averaged pixel data is not associated with the first linehead, the averaged pixel data from an image captured by a preceding linehead is subtracted from the averaged pixel data in the image to produce averaged pixel data that is associated with a single linehead. Derivative data of the averaged pixel data is then determined. A determination is made as to whether one or more peaks are present in the derivative data.

5 Claims, 7 Drawing Sheets

IDENTIFYING A LINEHEAD PRODUCING AN ARTIFACT IN CONTENT PRINTED ON A MOVING PRINT MEDIA

CROSS-REFERENCE TO RELATED APPLICATION

This patent application is related to U.S. patent application Ser. No. 13/536,165, entitled "IDENTIFYING A LINEHEAD PRODUCING AN ARTIFACT IN CONTENT PRINTED ON A MOVING PRINT MEDIA" filed concurrently herewith. This patent application is related to U.S. patent application Ser. No. 13/332,415 and U.S. patent application Ser. No. 13/332,417, both filed on Dec. 21, 2011.

TECHNICAL FIELD

The present invention generally relates to printing systems and more particularly to methods and systems for identifying one or more lineheads that is producing an artifact in content printed on a moving print media.

BACKGROUND

In commercial inkjet printing systems, a print media is physically transported through the printing system at a high rate of speed. For example, the print media can travel 650-1000 feet per minute. The printheads in commercial inkjet printing systems typically include multiple nozzle plates, with each nozzle plate having precisely spaced and sized nozzles. The cross-track pitch, measured as drops per inch or dpi, is determined by the nozzle spacing. The dpi can be as high as 600, 900, or 1200 dpi. Due to the speed of the moving print media and the high dpi, a reliable system or method is desired for jetting the ink onto the moving print media, for maintaining the alignment of the moving print media with respect to the printheads, and for detecting defects or artifacts in the content printed on the moving print media.

Generally, the streams of drops emitted by each nozzle plate are parallel to each other in order to produce a uniform density on the moving print media. But different failure modes can produce artifacts in the content printed on the moving print media. For example, artifacts are produced by failures in drop deposition or in stitching algorithms that stitch together regions where printheads overlap. These artifacts continue until the problem is corrected. Unfortunately, the necessary corrections may not occur for hundreds or thousands of feet of print media, which results in waste when the printed content is not usable. Additionally, wasted print media causes the print job to be more costly and time consuming.

There are two issues surrounding current artifact or defect detection systems, size and purpose. Current artifact detection systems use cameras configured to image the printed content in a fashion that represents a two-dimensional high resolution scene of the printed content. In order to create a two-dimensional high resolution representation of the printed content, the integration period of the camera is kept relatively short to avoid the blurring associated with longer integration times. Short integration times can be achieved by using a very intense illumination for short bursts that are synchronized with camera integration periods (frequently referred to as strobe illumination), by using a camera with high sensitivity and with short integration periods, or combinations thereof.

One conventional configuration for such cameras is to attach an imaging lens to the camera and then mount the camera to the structure at the distance appropriate to produce a focused image of the print media. The physical configuration of the separate components in the imaging system can consume a large volume of space within or around the printing system. Additionally, it can be difficult to shield the components of the imaging system from the environment created in or around the printing system. Elevated humidity, temperature and a dusty atmosphere can adversely impact the performance of one or more components in the imaging system.

Two-dimensional high resolution imaging of printed content on high speed printers typically requires higher performance cameras and light sources. High resolution imaging can also require the transmission of large amounts of data from the imaging system to a processing device. Due to the amount of data, the processing device requires increasing processing power and time, as well as potentially more complex analysis algorithms, to analyze the data. All of these factors can increase the cost to manufacture and the cost to operate an artifact detection imaging system.

As noted earlier, the other issue with current artifact detection systems is the purpose or product produced by the imaging system. Most commercially available imaging systems are designed to detect discrete artifacts in the printed content, such as impurities or non-uniformities that differ from a nominally uniform background. These non-conforming artifacts can range in size from microns to millimeters. The non-conforming artifacts are randomly dispersed within an otherwise uniform background, which can be wide and moving at a high speed. An example may be a speck of dirt or a strand of hair inadvertently trapped on a paper surface during the manufacturing of a wide roll of paper, and the imaging system is designed to detect these features on a continuous basis. Because these artifacts can be small, the resolution of the camera sensor needs to be sufficiently high to resolve features at the micron level. For example, a 600 dpi resolution imaging sensor can resolve approximately 40 microns, while a 1200 dpi sensor can resolve approximately 20 microns. Higher resolution sensors are usually costlier than lower resolution sensors.

Furthermore, commercially available imaging systems are purposefully designed to avoid blur in the captured image so that the image processing of the captured images can use algorithms to accurately determine the nature of these artifacts. To achieve high resolution, non-blurred images, the imaging systems use high pixel density, two-dimensional (2D) area array sensors capable of a high refresh rate so that large areas of the moving print media can be captured sequentially and continuously. The captured images are then processed to determine the small and randomly occurring artifacts. The larger the digital data set (from the higher resolution sensors or cameras) the more costly the image processing hardware.

High refresh rate systems may also need to use special lighting capable of providing uniform and bright strobe lighting. In order to image large areas across a wide moving print media, captured images from several two-dimensional sensors need to be stitched together or relatively large two-dimensional sensors are required. Given the nominal capability of such high performance imaging systems to meet the needs of the printing industry and the heretofore small number of inkjet printers installed in the industry, there has been little demand for commercial vendors to develop separate imaging systems that can detect printing artifacts that are characteristic of ink jet based printing systems. The cost of printing systems places an exaggerated constraint on the number of imaging systems that can be used with an ink jet printing system, since several such imaging systems may be necessary or beneficial to ensure print quality.

SUMMARY

In one aspect, a printing system includes lineheads disposed over a moving print media and integrated imaging systems that capture images of the moving print media. An integrated imaging system is positioned downstream of each linehead and, when there is a subsequent linehead along the media transport direction, upstream of the next linehead. A linehead that is producing an artifact in the content printed on the print media is identified by capturing an image of the content as the print media is moving to obtain pixel data and averaging the pixel data to produce blur in a direction the print media is moving and determining whether the averaged pixel data is associated with content printed by a first linehead in the printing module. If the averaged pixel data is not associated with the content printed by the first linehead, the averaged pixel data from an image captured by a preceding linehead is subtracted from the averaged pixel data in the image to produce averaged pixel data that is associated with a single linehead. Derivative data of the averaged pixel data is then determined. A determination is made as to whether one or more peaks are present in the derivative data. If one or more peaks is present in the derivative data, the linehead that is producing the artifact or artifacts is identified based on the one or more peaks.

In another aspect, a type of artifact can be determined using a shape and direction of at least one peak in the derivative data.

In another aspect, a printing system includes multiple lineheads that each jet ink or liquid onto a moving print media. An integrated imaging system is positioned downstream of each linehead and, when there is a subsequent linehead along the media transport direction, upstream of the next linehead. An image processing device is connected to each integrated imaging system and configured to identify one or more lineheads that are producing one or more artifacts in the content printed on the print media by receiving pixel data produced by each linehead and producing pixel data associated with only one linehead and analyzing the pixel data associated with each linehead.

BRIEF DESCRIPTION OF THE DRAWINGS

Embodiments of the invention are better understood with reference to the following drawings. The elements of the drawings are not necessarily to scale relative to each other.

DETAILED DESCRIPTION

Figure 1:
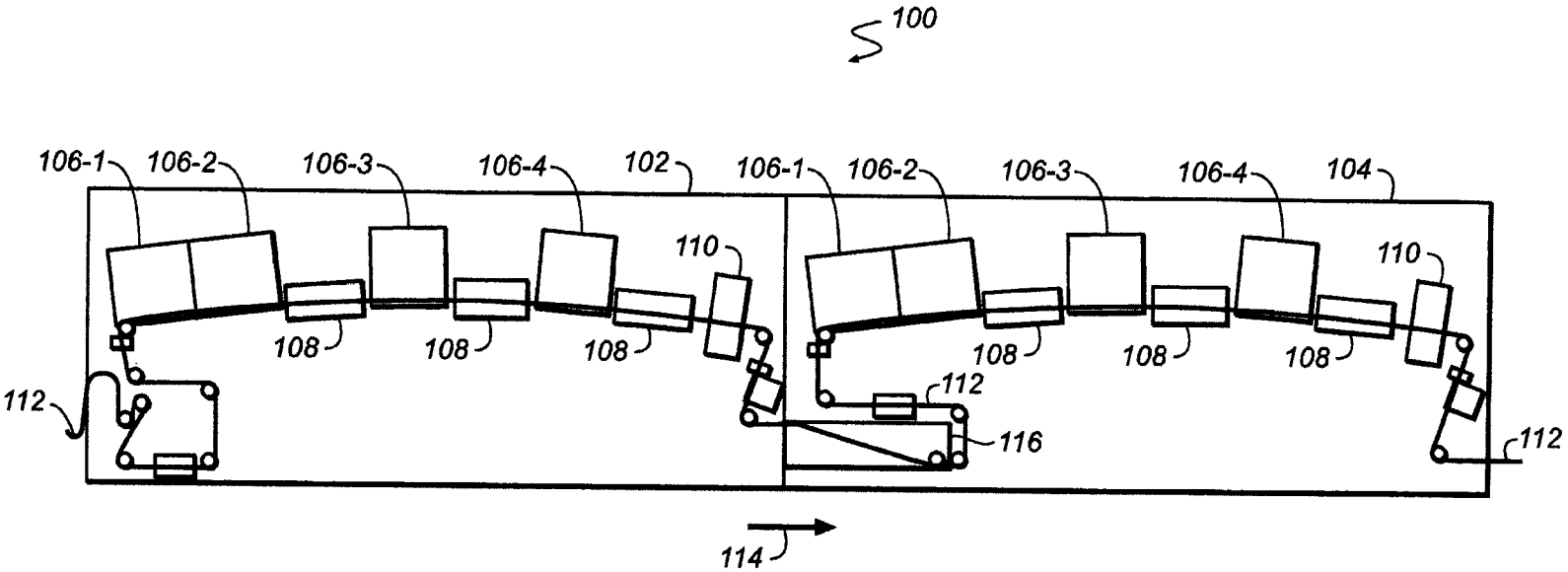
FIG. 1 illustrates one example of an inkjet printing system for continuous web printing on a print media.

Throughout the specification and claims, the following terms take the meanings explicitly associated herein, unless the context clearly dictates otherwise. The meaning of "a," "an," and "the" includes plural reference, the meaning of "in" includes "in" and "on." Additionally, directional terms such as "on", "over", "top", "bottom", "left", "right" are used with reference to the orientation of the Figure(s) being described. Because components of embodiments of the present invention can be positioned in a number of different orientations, the directional terminology is used for purposes of illustration only and is in no way limiting.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper. However, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of an ink to a print media. Typically, one of two types of ink jetting mechanisms are used and are categorized by technology as either drop on demand ink jet (DOD) or continuous ink jet (CIJ). The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CU) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of print media used with inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system.

The invention described herein is applicable to both types of printing technologies. As such, the term printhead, as used herein, is intended to be generic and not specific to either technology. Additionally, the invention described herein is applicable to both types of print media. As such, the term print media, as used herein, is intended to be generic and not as specific to either type of print media or the way in which the print media is moved through the printing system.

Figure 2:
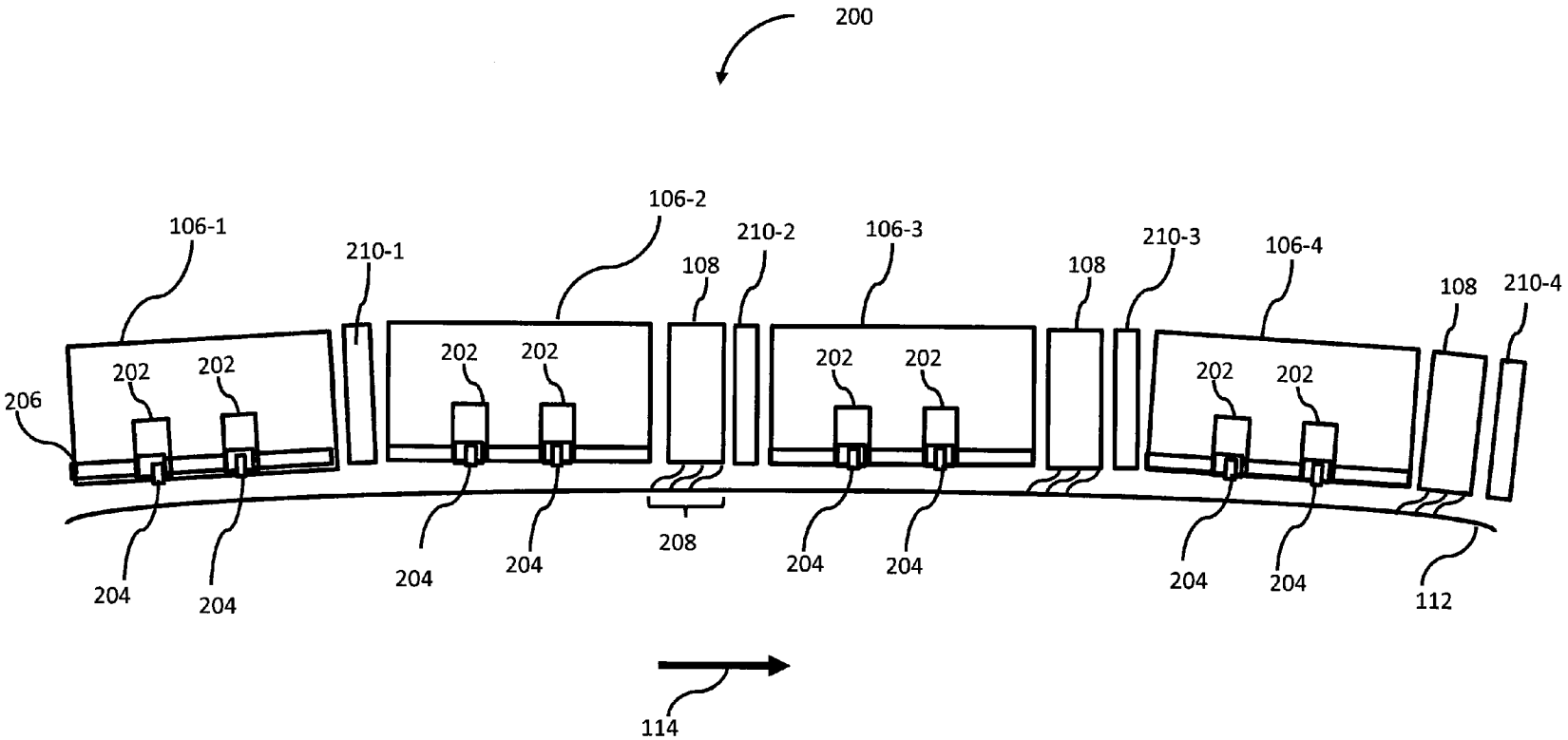
FIG. 2 illustrates a portion of one example of a printing system in an embodiment in accordance with the invention.
Figure 3:
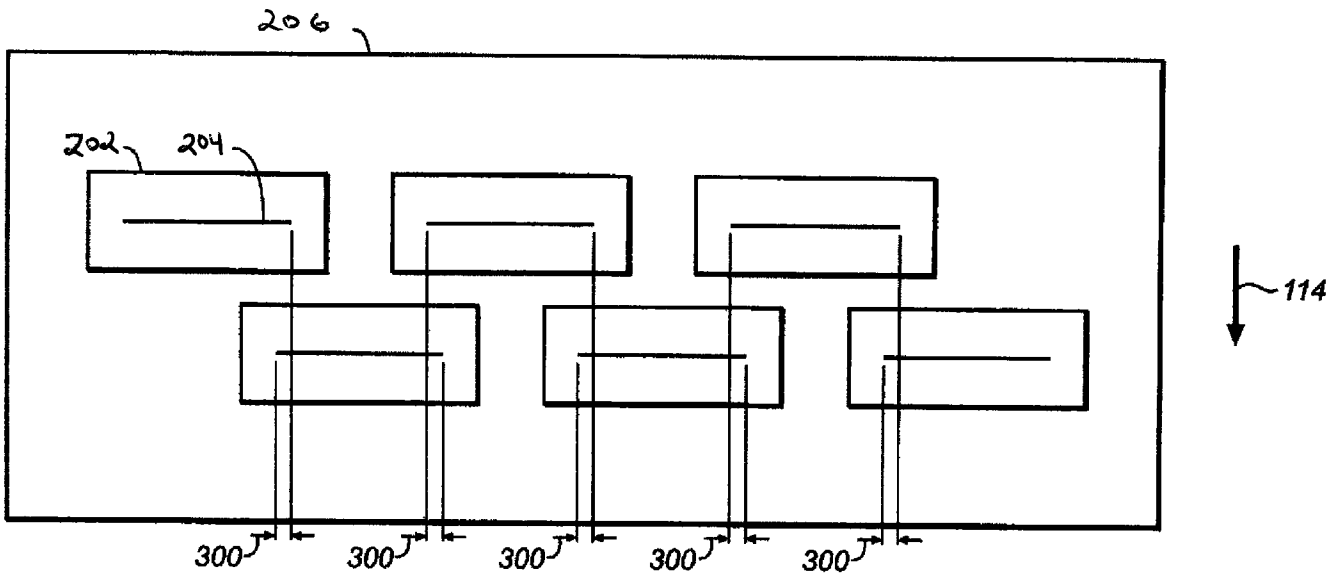
FIG. 3 illustrates a side of the support structure 206 that is adjacent to the print media 112 in an embodiment in accordance with the invention.

The terms "upstream" and "downstream" are terms of art referring to relative positions along the transport path of the print media; points on the transport path move from upstream to downstream. In FIGS. 1, 2 and 3, the media moves in the direction indicated by transport direction arrow 114. Where they are used, terms such as "first", "second", and so on, do not necessarily denote any ordinal or priority relation, but are simply used to more clearly distinguish one element from another.

Referring now to the schematic side view of FIG. 1, there is shown one example of an inkjet printing system for continuous web printing on a print media. Printing system 100 includes a first printing module 102 and a second printing module 104, each of which includes lineheads 106, dryers 108, and a quality control sensor 110. Each linehead 106 typically includes multiple printheads (not shown) that apply ink or another liquid to the surface of the print media 112 that is adjacent to the printheads. For descriptive purposes only, the lineheads 106 are labeled a first linehead 106-1, a second linehead 106-2, a third linehead 106-3, and a fourth linehead 106-4. In the illustrated embodiment, each linehead 106-1, 106-2, 106-3, 106-4 applies a different colored ink to the surface of the print media 112 that is adjacent to the lineheads. By way of example only, linehead 106-1 applies cyan colored ink, linehead 106-2 magenta colored ink, linehead 106-3 yellow colored ink, and linehead 106-4 black colored ink.

The first printing module 102 and the second printing module 104 also include a web tension system that serves to physically move the print media 112 through the printing system 100 in the transport direction 114 (left to right as shown in the figure). The print media 112 enters the first printing module 102 from a source roll (not shown) and the linehead(s) 106 of the first module applies ink to one side of the print media 112. As the print media 112 feeds into the second printing module 104, a turnover module 116 is adapted to invert or turn over the print media 112 so that the linehead(s) 106 of the second printing module 104 can apply ink to the other side of the print media 112. The print media 112 then exits the second printing module 104 and is collected by a print media receiving unit (not shown).

FIG. 2 illustrates a portion of one example of a printing system in an embodiment in accordance with the invention. As the print media 112 is directed through printing system 200, the lineheads 106, which typically include a plurality of printheads 202, apply ink or another liquid onto the print media 112 via the nozzle arrays 204 of the printheads 202. The printheads 202 within each linehead 106 are located and aligned by a support structure 206 in the illustrated embodiment. After the ink is jetted onto the print media 112, the print media 112 passes beneath the dryers 108 which apply heated air 208 to the ink on the print media.

Integrated imaging systems 210 are positioned opposite the print media 112 and capture images of the print media 112. An integrated imaging system 210 is positioned downstream of each linehead and, if there is a subsequent linehead along the transport direction 114, upstream of the next linehead. The integrated imaging system 210 is described in more detail in conjunction with FIGS. 7-9.

In the illustrated embodiment, integrated imaging system 210-1 is positioned downstream of linehead 106-1 and upstream of linehead 106-2. Another integrated imaging system 210-2 is positioned downstream of linehead 106-2 and a dryer 108 and upstream of linehead 106-3. Integrated imaging system 210-3 is positioned downstream of linehead 106-3 and the dryer 108 and upstream of linehead 106-4. And finally, an Integrated imaging system 210-4 is positioned downstream of linehead 106-4 and the dryer 108.

Referring now to FIG. 3, there is shown a side of the support structure 206 that is adjacent to the print media 112 in an embodiment in accordance with the invention. The printheads 202 are aligned in a staggered formation, with upstream and downstream printheads 202, such that the nozzle arrays 204 produce overlap regions 300. The overlap regions 300 enable the print from overlapped printheads 202 to be stitched together without a visible seam through the use of appropriate stitching algorithms that are known in the art. These stitching algorithms ensure that the amount of ink printed in the overlap region 300 is not higher than other portions of the print.

In a commercial ink jet printing system, such as the printing system depicted in FIG. 1, the printheads 202 are typically 4.25 inches wide and multiple printheads 202 are used to cover the varying widths of different types of print media. For example, the widths of the print media can range from 4.25 inches to 52 inches. Each nozzle array 204 includes one or more lines of openings or nozzles that emit ink drops. The ink drops have a particular pitch or spacing in the cross-web direction. The cross-web pitch is determined by the spacing between nozzles. For example, cross-web ink drop pitches can vary from 300 to 1200 drops per inch.

Figure 6:
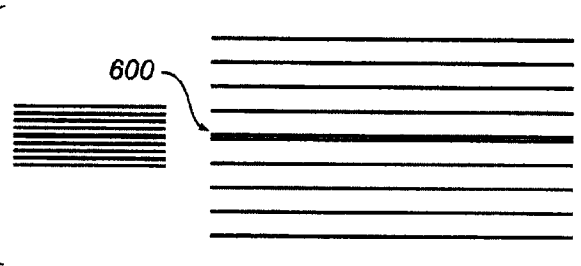
Figure 5:
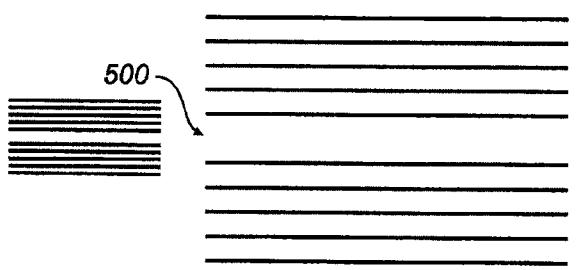

Embodiments in accordance with the invention detect artifacts in content printed on a moving print media and determine which linehead or lineheads is producing the artifacts. The artifacts that can be detected include, but are not limited to, stitching errors, flat field, density variation, and streaks or banding. FIGS. 5-6 are used to describe streaking artifacts that extend in the media transport direction.

Figure 4:
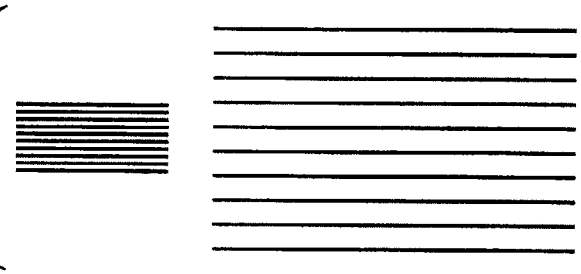
FIGS. 4-6 are graphical illustrations of possible streams of ink drops and expanded views of the possible streams in an embodiment in accordance with the invention.

Streams of print drops can travel a distance of about 1 to 15 mm from the printhead to the print media in some printing systems. FIG. 4 illustrates a desired pattern of ink drops and an expanded view of the desired pattern. The streams of ink drops are illustrated as lines for simplicity. As shown in FIG. 4, the streams of drops are parallel to each other at the proper pitch. This produces a uniform density on the print media.

Streams which are not parallel result in density variations that are seen as adjacent light and dark band regions. When a nozzle stops ejecting ink drops (see FIG. 5), a blank streak 500 is created that continues until ink is again ejected from the nozzle. A "stuck on" nozzle will produce a dark line 600 for the duration of the "stuck on" event (see FIG. 6).

A crooked nozzle also creates an artifact in printed content. The ink jetted from a crooked nozzle can intersect with an ink stream from one or more neighboring nozzles and produce a darker streak where the conjoined streams land on the print media and an adjacent lighter streak (or streaks) where the deviated streams are missing from the intended region of the print media. These described print defects (lighter and darker streaks) continue until the problem is corrected, and corrections may not occur for hundreds or thousands of feet of print media.

Figure 7:
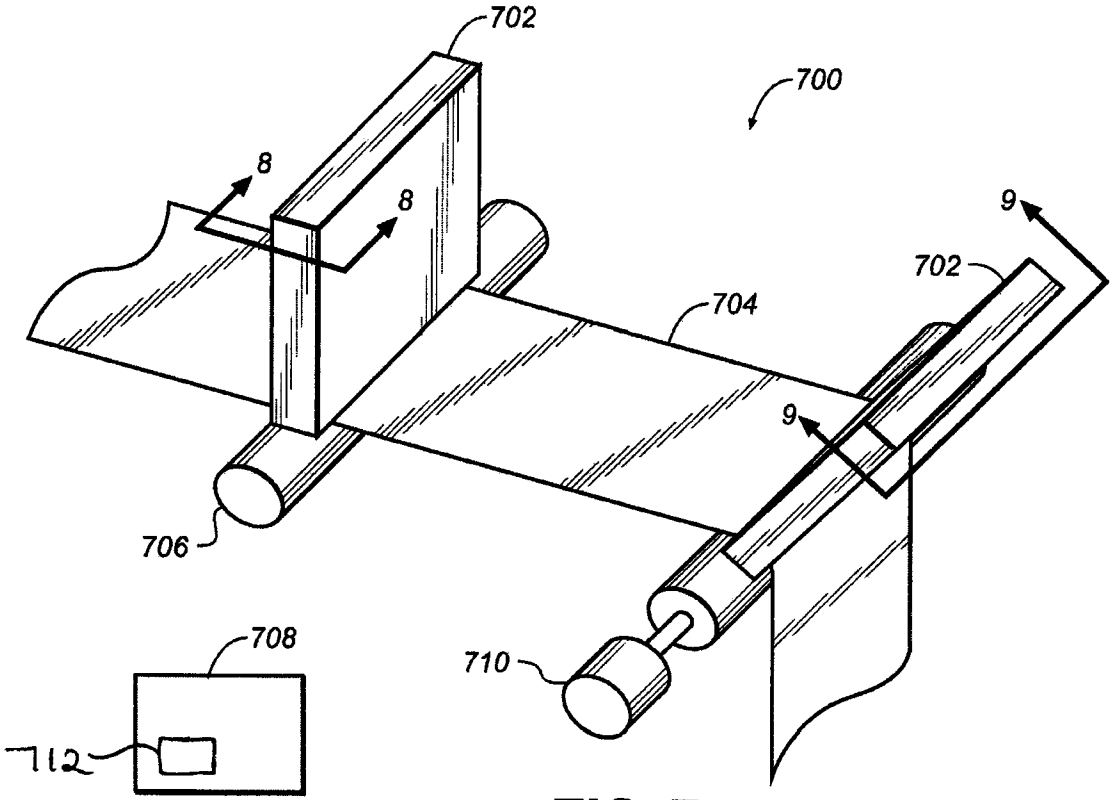
FIG. 7 depicts a portion of a printing system in an embodiment in accordance with the invention.

Referring now to FIG. 7, there is shown a portion of a printing system in an embodiment in accordance with the invention. Printing system 700 includes one or more integrated imaging systems 702 disposed over the print media 704. The integrated imaging systems 702 are connected to an image processing device 708 that can be used to process and detect artifacts in the printed content on the print media 704. Communications and data transmission between the integrated imaging systems 702 and the image processing device 708 can be performed using any known wired or wireless connection. Image processing device 708 can be external to printing system 700; integrated within printing system 700; or integrated within a component in printing system 700. The image processing device 708 can be implemented with one or more processing devices, such as a computer or a programmable logic circuit.

The integrated imaging systems 702 are disposed over the print media 704 at locations in a printing system where the print media is transported over rollers 706 in an embodiment in accordance with the invention. The print media can be more stable, both in the cross-track and in-track (feed) directions, when moving over the rollers 706. In other embodiments in accordance with the invention, one or more integrated imaging systems can be positioned at locations where the print media is not transported over rollers or other support components.

Motion encoder 710 can be used to produce an electronic pulse or signal proportional to a fixed amount of incremental motion of the print media in the feed direction. The signal from motion encoder 710 is used to trigger an image sensor (see 806 in FIG. 8) to begin capturing an image of the printed content on the moving print media using the light reflected off the print media.

Connected to the image processing device 708 is one or more storage devices 712. The storage device 712 can be used to store data used by the lineheads when printing content on the print media or used to control settings or operations of various components within the printing system. The storage device 712 can be implemented as one or more external storage devices; one or more storage devices included within the image processing device 708; or a combination thereof.

Figure 8:
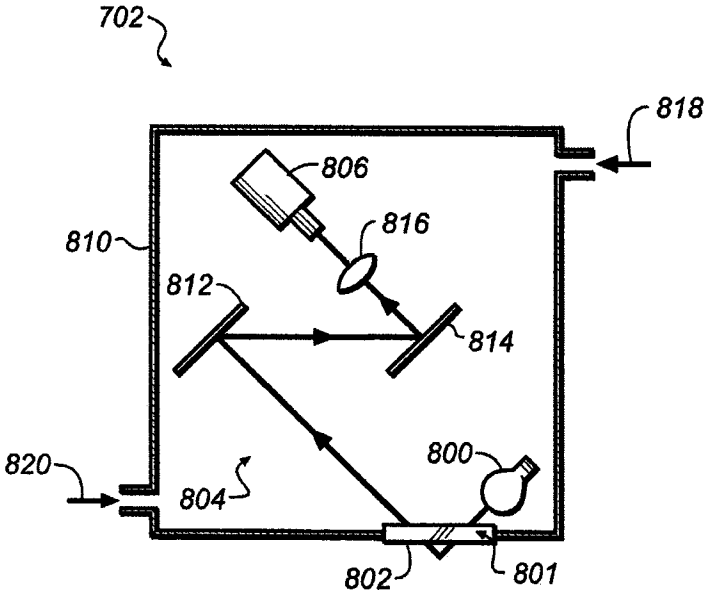
FIG. 8 is a cross-sectional view along line 8-8 in FIG. 7 in an embodiment in accordance with the invention.

FIG. 8 is a cross-sectional view along line 8-8 in FIG. 7 in an embodiment in accordance with the invention. Integrated imaging system 702 includes light source 800, transparent cover 802, folded optical assembly 804, and image sensor 806 all enclosed within housing 810. In the illustrated embodiment, folded optical assembly 804 includes mirrors 812, 814 and lens 816. Mirrors 812, 814 can be implemented with any type of optical elements that reflects light in embodiments in accordance with the invention.

Light source 800 transmits light through transparent cover 802 and towards the surface of the print media (not shown). The light reflects off the surface of the print media and propagates through the transparent cover 802 and along the folded optical assembly 804, where mirror 812 directs the light towards mirror 814, and mirror 814 directs the light toward lens 816. The light is focused by lens 816 to form an image on image sensor 806. Image sensor 806 captures one or more images of the print media as the print media moves through the printing system by converting the reflected light into electrical signals.

Folded optical assembly 804 bends or directs the light as it is transmitted to image sensor 806 such that the optical path traveled by the light is longer than the size of integrated imaging system 702. Folded optical assembly 804 allows the imaging system 702 to be constructed more compactly, reducing the weight, dimensions, and cost of the imaging system. Folded optical assembly 804 can be constructed differently in other embodiments in accordance with the invention. Additional or different optical elements can be included in folded optical assembly 804.

As discussed earlier, image sensor 806 can receive a signal from a motion encoder (e.g., 710 in FIG. 7) each time an incremental motion of the print media occurs in the feed direction. The signal from the motion encoder is used to trigger image sensor 806 to begin integrating the light reflected from the print media. In the case of a linear image sensor, the unit of incremental motion is typically configured such that an integration period begins with sufficient frequency to sample or image the print media in the feed direction with the same resolution as is produced in the cross-track direction. If the trigger occurs at a rate which produces a rate that results in sampling in the in-track (feed) direction at a higher rate, an image that is over sampled in that direction is produced and the imaged content appears elongated or stretched in the in-track direction. Conversely, a rate that is lower for the in-track direction produces imaged content that is compressed in the in-track direction.

The time period over which the integration occurs determines how much print media moves through the field of view of the imaging system. With shorter integration periods such as a millisecond or less, the motion of the print media can be minimized so that fine details in the in-track direction can be imaged. When longer integration periods are used, the light reflected off the print media is collected while the print media is moving and the motion of the print media means the printed content is blurred in the direction of motion. The blurring in the direction of motion has the effect of averaging the pixel data in one direction, the in-track (feed) direction. Averaging the pixel data through blurring is also known as optical averaging. By performing the averaging optically with longer integration periods, the amount of data that is transferred to and processed by a processing device (e.g., 708 in FIG. 7) is reduced. Blurring reduces image resolution in the in-track direction, and is therefore generally avoided for applications that require the identification of artifacts that are small and occur randomly.

The transparent cover 802 is disposed over an opening 801 in the housing 810. Transparent cover 802 is optional and can be omitted in other embodiments in accordance with the invention.

Integrated imaging system 702 can also include vent openings 818, 820. Vent opening 818 can be used to input air or gas while vent opening 820 can be used to output exhaust. The input air or gas can be used to maintain a clean environment and control the temperature within integrated imaging system 702. In another embodiment in accordance with the invention, integrated imaging system 702 can include one or more vent openings (e.g., vent opening 818) that input air or gas and the opening 801 in the housing 810 used to output exhaust.

Figure 9:
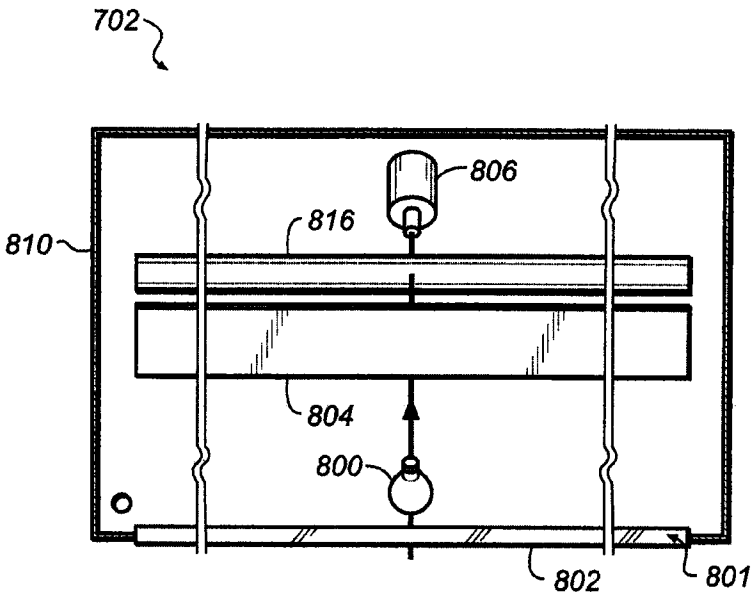
FIG. 9 is a cross-sectional view along line 9-9 in FIG. 7 in an embodiment in accordance with the invention.

FIG. 9 is a cross-sectional view along line 9-9 in FIG. 7 in an embodiment in accordance with the invention. As described, light source 800 transmits light through transparent cover 802 and towards the surface of the print media (not shown). The light reflects off the surface of the print media, propagates along folded optical assembly, and is directed toward lens 816. Lens 816 focuses the light to form an image on image sensor 806.

Image sensor 806 can be implemented with any type of image sensor, including, but not limited to, one or more linear image sensors constructed as a charge-coupled device (CCD) image sensor or a complementary metal oxide semiconductor (CMOS) image sensor. Image sensor 806 can include a color filter array (CFA) formed over the photosensitive pixels in the image sensor. Image sensors and the use of CFAs are well known in the art and will not be described in detail herein. Briefly, a CFA is a mosaic of color filter elements. The color filter elements filter light by a specific wavelength range, allowing the pixels to capture images that include information about the color of the light.

In one embodiment in accordance with the invention, a linear image sensor includes a CFA having color filter elements that filter light by a wavelength range associated with, or based on, an ink color used in printing content on the print media. By way of example only, a printing system can use cyan, magenta, yellow and black colored inks. The integrated imaging systems in the printing system can each include four linear image sensors with one image sensor having a CFA that filters light in the wavelength range based on cyan, another image sensor having a CFA that filters light in the wavelength range based on magenta, and one image sensor having a CFA that filters light in the wavelength range based on yellow.

Figure 10:
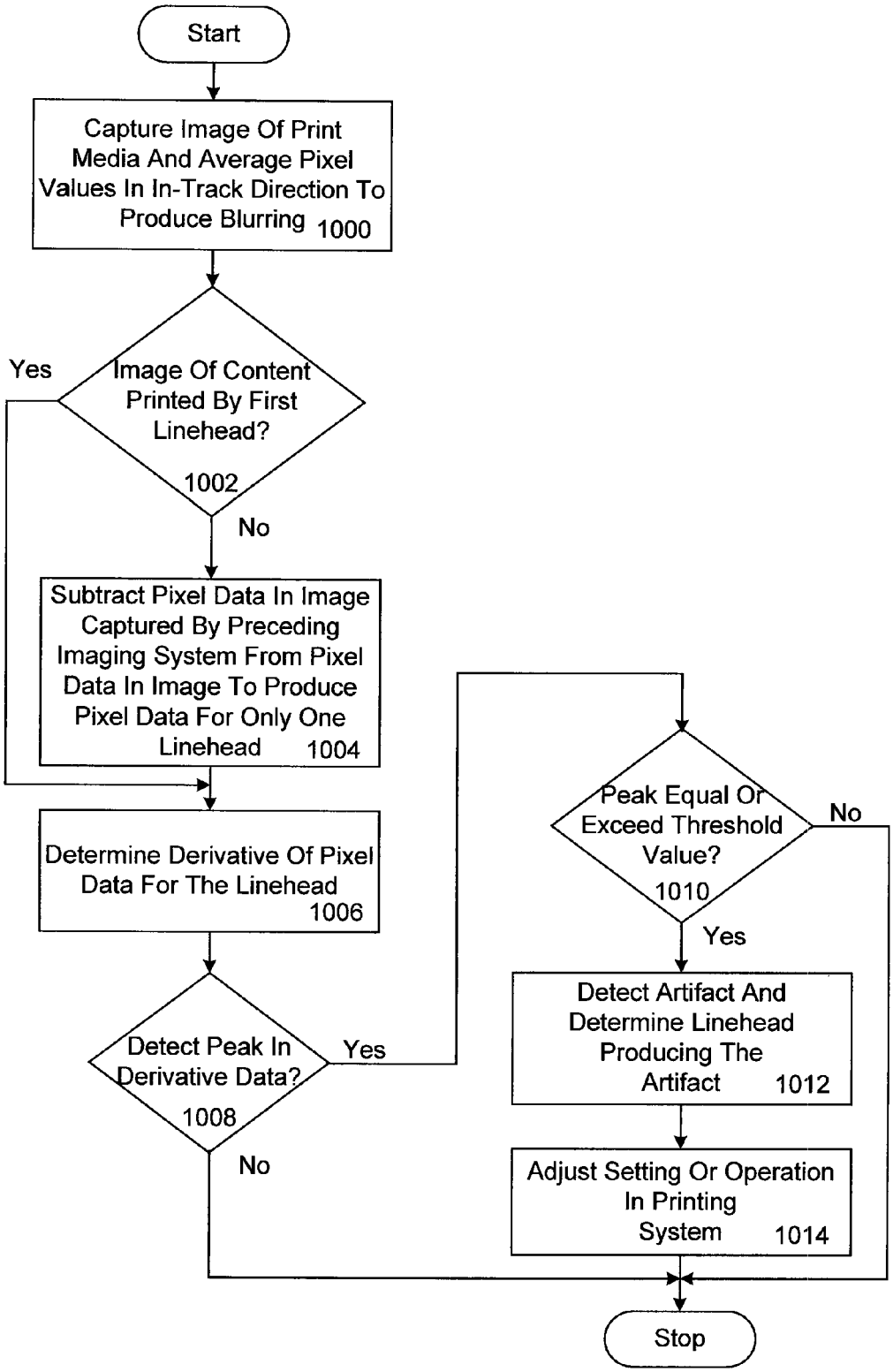
FIG. 10 is a flowchart of a method for identifying a linehead that is producing an artifact in content printed on a moving print media in an embodiment in accordance with the invention.

The images of the print media formed on the image sensor 806 are converted to a digital representation that is suitable for analysis in a computer or processing device. By way of example only, the image processing device 708 can be used to process the images, detect any artifacts and determine the linehead or lineheads producing the artifacts. Referring now to FIG. 10, there is shown a flowchart of a method for identifying a linehead that is producing an artifact in content printed on a moving print media in an embodiment in accordance with the invention. The method is described in conjunction with one artifact, but those skilled in the art will recognize the method can be used to detect multiple artifacts. Additionally, the method is described with reference to one linehead, but those skilled in the art will appreciate the method can be used with multiple lineheads, either simultaneously or at select times.

Typically, each linehead in a printing system jets only one color of ink, so a printing system includes a linehead for each color of ink. As discussed in conjunction with FIG. 2, embodiments in accordance with the invention position an integrated imaging system downstream of each linehead and, if there is a subsequent linehead along the transport direction, upstream of the next linehead. This allows each integrated imaging system to capture an image of the printed content after each ink color is printed on the print media.

Initially, an image of the content printed on the moving print media is captured by an integrated imaging system and the pixel data averaged in the in-track direction to produce blurring in the image or images (block 1000). The pixel data is averaged optically through the use of a longer integration time in one embodiment in accordance with the invention. The amount of optical averaging can be increased by reducing the frequency of the pulses from the motion encoder (e.g., 710 in FIG. 7) and extending the integration time of the image sensor (e.g., 806 in FIG. 8) in the imaging system (e.g., 702 in FIG. 8). Reducing the frequency of the pulses has the benefit of reducing the amount of data transferred to the image processing device and of reducing the numerical averaging performed by the image processing device (e.g., 708 in FIG. 7). Additional numerical averaging or other image processing of the pixel data in the in-track direction can be computed by the processing device on images captured by the image sensor. The amount of optical image averaging can be decreased with an increase in the numerical averaging required. The ability to using optical averaging not only significantly reduces the camera hardware cost, but also its footprint size, and all without sacrificing the ability to detect inkjet printing related artifacts.

In another embodiment in accordance with the invention, averaging of the pixel data in one direction can be performed by a processing device (e.g., 708 in FIG. 7) using multiple images captured by the integrated imaging system. The images can be captured with shorter integration times in an embodiment in accordance with the invention. The processing device numerically averages the pixel data in one direction, the in-track direction, to produce blurring in an image or images. The processing device can also perform other types of imaging processing procedures in addition to the numerical averaging of the pixel data.

A determination is then made at block 1002 as to whether or not the image represents content printed by the first linehead in a printing system or printing module (e.g., linehead 106-1 in module 102 and in module 104 in FIG. 1). The pixel data in the image representing content printed by the first linehead is associated with only one linehead.

If the image does not represent content printed by the first linehead, the method passes to block 1004 where the pixel data from the image captured by the immediately preceding integrated imaging system is subtracted from the pixel data in the current image to produce pixel data that is associated with only one linehead. For example, an image captured by the integrated imaging system 210-1 is associated only with linehead 210-1. But an image captured by the integrated imaging system 210-2 includes content printed by both lineheads 210-1 and 210-2. So the pixel data from the image captured by integrated imaging system 210-1 is subtracted from the pixel data from the image captured by integrated imaging system 210-2 to produce pixel data associated with only linehead 210-2.

Figure 11:
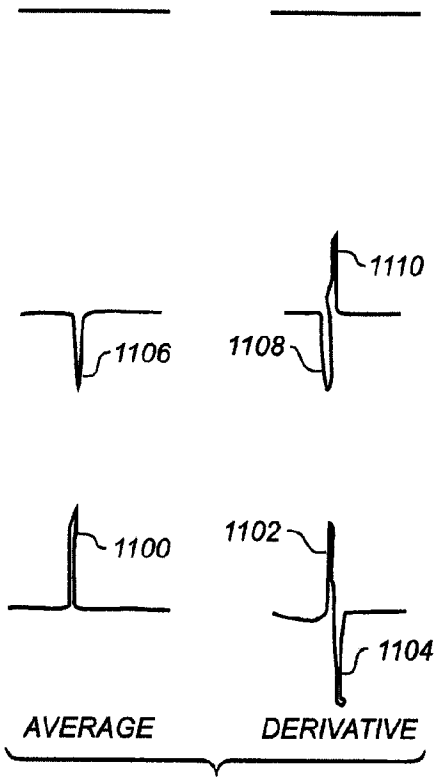
FIG. 11 is an example plots of averaged pixel data and plots of derivative data for the streams of ink drops shown in FIGS. 4-6 in an embodiment in accordance with the invention.

When the image represents content printed by the first linehead at block 1002, or when the pixel data from the image captured by the immediately preceding integrated imaging system has been subtracted from the pixel data in the current image at block 1004, the process continues at block 1006 where a derivative of the averaged pixel data is determined. A determination is then made at block 1008 as to whether or not a peak is detected in the derivative data. Artifacts produce high and low peaks in the derivative data, as shown in FIG. 11. For example, the average of the pixel data for the blank streak depicted in FIG. 5 produces an upward peak 1100 in the plot of the averaged pixel data and an upward peak 1102 followed by a downward peak 1104 in the plot of the derivative data.

For the darker streak shown in FIG. 6, the average of the pixel data produces a downward peak 1106 in the plot of the averaged pixel data and a downward peak 1108 followed by an upward peak 1110 in the plot of the derivative data. The shape and direction of the peaks in the derivative data can be used to identify the type of artifact in some embodiments in accordance with the invention.

When the streams of ink drops are uniform and evenly spaced, as shown in FIG. 4, there are no peaks in the plots of the average of the pixel data or in the derivative data.

If a peak or peaks is detected, a determination is made at block 1010 as to whether or not the value of the peak equals or exceeds a threshold value. If the value of the peak is equal to or greater than the threshold value, an artifact is detected and the linehead that produced the artifact is identified (block 1012).

One or more operations or settings are adjusted based on the detection of the artifact and the linehead that is producing the artifact. The shape and direction of the peaks in the derivative data can be used to identify the type of artifact and assist in the correction of the event that is producing the artifact. By way of example only, the times at which ink drops are ejected can be modified, the print data values transmitted to a linehead can be modified, or the speed of the print media can be changed.

The method shown in FIG. 10 is performed substantially simultaneously for all of the lineheads in a printing system in one embodiment in accordance with the invention. In another embodiment, the method is performed for each linehead or for groups of lineheads at select times. Additionally, other embodiments in accordance with the invention can modify, delete, or add blocks to the embodiment shown in FIG. 10. For example, block 1010 can be omitted in other embodiments.

Although the artfiacts have been described with reference to streaks or banding that extend in the media transport direction (see FIGS. 5 and 6), embodiments in accordance with the invention can detect other types of artifacts. As described earlier, embodiments in accordance with the invention can detect other types of errors, including, but not limited to, stitching errors, flat field errors, density variation, and banding errors. Additionally, other embodiments in accordance with the invention can detect edges of the print media independent of, or in conjunction with, detecting print artifacts.

In embodiments where each linehead in a printing system jets only one color of ink, the color plane that has the print artifact is detected along with the linehead producing the artifact. The term "color plane" refers to the ink color that is deposited onto the print media. So a printing system that prints with cyan, magenta, yellow, and black colored inks prints four color planes (a cyan color plane, a magenta color plane, a yellow color plane, and a black color plane).

Other printing systems can have lineheads that jet multiple ink colors. The method of FIG. 10 can be used to detect the linehead that is producing the artifact. Additional image processing can then be performed to identify the ink color that has the artifact or artifacts.

The invention has been described in detail with particular reference to certain preferred embodiments thereof, but it will be understood that variations and modifications can be effected within the spirit and scope of the invention. And even though specific embodiments of the invention have been described herein, it should be noted that the application is not limited to these embodiments. In particular, any features described with respect to one embodiment may also be used in other embodiments, where compatible. And the features of the different embodiments may be exchanged, where compatible.

1. A printing system can include lineheads disposed over a moving print media and integrated imaging systems that capture images of the moving print media. An integrated imaging system is positioned downstream of each linehead and, when there is a subsequent linehead along the media transport direction, upstream of the next linehead. A linehead that is producing an artifact in the content printed on the print media is identified by capturing an image of the content as the print media is moving to obtain pixel data and averaging the pixel data to produce blur in a direction the print media is moving and determining whether the averaged pixel data is associated with content printed by a first linehead in the printing module. If the averaged pixel data is not associated with the content printed by the first linehead, the averaged pixel data from an image captured by a preceding linehead is subtracted from the averaged pixel data in the image to produce averaged pixel data that is associated with a single linehead. Derivative data of the averaged pixel data is then determined. A determination is made as to whether one or more peaks are present in the derivative data. If one or more peaks is present in the derivative data, the linehead that is producing the artifact or artifacts is identified based on the one or more peaks.

2. The method in clause 1 can include determining a type of artifact using a shape and direction of at least one peak in the derivative data.

3. The method as in clause 1 or clause 2, where averaging the pixel data to produce blur in a direction the print media is moving comprises optical averaging.

4. The method as in clause 1 or clause 2, where averaging the pixel data to produce blur in a direction the print media is moving comprises numerical averaging.

5. The method in any one of clauses 1-4 can include determining whether one or more peaks detected in the derivative data equals or exceeds a threshold value, and if at least one peak equals or exceeds the threshold value, identifying the linehead that is producing the artifact or artifacts based on the one or more peaks.

6. A printing system can include multiple lineheads that each jet ink or liquid onto a moving print media. An integrated imaging system is positioned downstream of each linehead and, when there is a subsequent linehead along the media transport direction, upstream of the next linehead. An image processing device is connected to each integrated imaging system and configured to identify one or more lineheads that are producing one or more artifacts in the content printed on the print media by receiving pixel data produced by each linehead and producing pixel data associated with only one linehead and analyzing the pixel data associated with each linehead.

7. The printing system as in clause 6, where each integrated imaging system can include at least two vent openings in the housing, one vent opening for inputting tempered air and one vent opening for outputting exhaust.

8. The printing system as in clause 6 or clause 7, where each integrated imaging system can include a light source for emitting light towards the print media.

9. The printing system as in any one of clauses 6-8, where each folded optical assembly can include a lens, and at least one mirror for directing the reflected light to the lens.

10. The printing system in any one of clauses 6-9 can include a transparent cover over the opening in the housing.

11. The printing system as in any one of clauses 6-10, where each integrated imaging system can include a vent opening in the housing for receiving air or gas.

12. The printing system as in clause 11, where the opening in the housing is used to output exhaust.

13. The printing system in any one of clauses 1-12 can include a roller for transporting the print media through the printing system.

14. The printing system in clause 13 can include a motion encoder connected to the roller, where the motion encoder is adapted to output a signal proportional to a fixed amount of incremental motion of the print media.

15. The printing system as in clause 13 or clause 14, where one integrated imaging system is disposed over the print media at a location where the print media is transported over the roller.

| PARTS LIST | |
|---|---|
| 100 | printing system |
| 102 | printing module |
| 104 | printing module |
| 106 | linehead |
| 108 | dryer |
| 110 | quality control sensor |
| 112 | print media |
| 114 | transport direction |
| 116 | turnover module |
| 200 | printing system |
| 202 | printhead |
| 204 | nozzle array |
| 206 | support structure |
| 208 | heat |
| 210 | integrated imaging system |
| 300 | overlap region |
| 500 | blank streak |
| 600 | darker streak |
| 700 | printing system |
| 702 | integrated imaging system |
| 704 | print media |
| 706 | roller |
| 708 | image processing device |
| 710 | motion encoder |
| 712 | storage device |
| 800 | light source |
| 801 | opening in housing |
| 802 | transparent cover |
| 804 | folded optical assembly |
| 806 | image sensor |
| 810 | housing |
| 812 | mirror |
| 814 | mirror |
| 816 | lens |
| 818 | vent |
| 820 | vent |
| 1100 | peak |

-continued

| PARTS LIST | |
|---|---|
| 1102 | peak |
| 1104 | peak |
| 1106 | peak |
| 1108 | peak |
| 1110 | peak |

The invention claimed is:

1. A method for identifying a linehead that is producing an artifact in content printed on a moving print media in a printing module that includes a plurality of lineheads, wherein a printing system includes one or more printing modules, the method comprising:

(a) capturing an image of the content as the print media is moving to obtain pixel data and averaging the pixel data to produce blur in a direction the print media is moving;

(b) determining whether the averaged pixel data is associated with content printed by a first linehead in the printing module;

(c) if the averaged pixel data is not associated with the content printed by the first linehead, subtracting averaged pixel data from an image captured by a preceding linehead from the averaged pixel data in the image to produce averaged pixel data that is associated with a single linehead;

(d) determining derivative data of the averaged pixel data;

(e) determining whether one or more peaks are present in the derivative data; and (f) if one or more peaks are present in the derivative data, identifying the linehead that is producing the artifact based on the one or more peaks.

2. The method as in claim 1, further comprising determining a type of artifact using a shape and direction of at least one peak in the derivative data.

3. The method as in claim 1, wherein averaging the pixel data to produce blur in a direction the print media is moving comprises optical averaging.

4. The method as in claim 1, wherein averaging the pixel data to produce blur in a direction the print media is moving comprises numerical averaging.

5. The method as in claim 1, further comprising:

prior to performing (f), determining whether one or more peaks detected in the derivative data equals or exceeds a threshold value; and if at least one peak equals or exceeds the threshold value, performing (f).

* * * * *